United States Patent [19]

Spolsino et al.

[11] Patent Number: 4,756,686

[45] Date of Patent: Jul. 12, 1988

[54] TORCH HANDLE WITH LOCKING VALVE

[75] Inventors: Peter P. Spolsino, Revere, Mass.; Clifford D. Raines, San Antonio, Tex.; Joseph P. DiSanto, Peabody; Claudio P. Negro, Lynn, both of Mass.

[73] Assignee: Wingaersheek Div. of Victor Equipment Company, Danvers, Mass.

[21] Appl. No.: 3,729

[22] Filed: Jan. 16, 1987

[51] Int. Cl.[4] ..... F23D 14/46

[52] U.S. Cl. ..... 431/345; 251/149.9

[58] Field of Search ..... 431/127, 327, 345, 353, 431/355; 251/149.8, 149.9, 343

[56] References Cited

U.S. PATENT DOCUMENTS

| | | | |
|---|---|---|---|
| 1,150,641 | 8/1915 | Smith . | |
| 1,574,768 | 3/1926 | Tuttle . | |
| 2,657,709 | 11/1953 | Gillerstrom, et al. . | |
| 3,589,673 | 6/1971 | Cruse | 251/149.9 |
| 3,645,500 | 2/1972 | Walter . | |
| 4,013,395 | 3/1977 | Wormser | 431/353 |

FOREIGN PATENT DOCUMENTS

| | | | |
|---|---|---|---|
| 2284254 | 4/1976 | France | 251/343 |
| 565183 | 7/1957 | Italy . | |

*Primary Examiner*—Samuel Scott
*Assistant Examiner*—Noah Kamen
*Attorney, Agent, or Firm*—Majestic, Gallagher, Parsons & Siebert

[57] ABSTRACT

A torch handle is provided which includes a mechanism for locking the valve in the closed position. An actuator collar is positioned to be manually actuable with one hand to a forwardmost or open position. The quick-disconnect coupling assembly has a coupling collar, which may be retracted to remove a torch tip and thereby moves the actuator collar to return the valve to the closed position.

8 Claims, 3 Drawing Sheets

TORCH HANDLE WITH LOCKING VALVE

BACKGROUND OF THE INVENTION

1. Field of the Invention

This invention is directed to an improved torch handle with locking valve. The valve includes a mechanism for shutting off gas flow through the torch handle incident to removal of the torch tip.

2. Description of the Prior Art

Numerous valve structures exist in the prior art for use in selectively channeling or directing fluids such as soldering or brazing gases. In a typical monopropellant soldering or brazing torch, a torch tip is removably attached to a torch handle assembly within which a manually operable valve is located. Some of these valves are spool valves wherein a spool having a series of openings is adapted for selectively communicating ports within a valve body upon manual movement of the spool. Other prior art valves are of the needle or ball valve type. Needle valves frequently have a short travel and are actuated by means of manually turning a valve wheel on the torch handle assembly. These valves are hard to operate and adjust by an operator having to wear heavy gloves used in soldering or welding applications. These valves are also difficult to operate with one hand. Many of these valves do not provide operator "feel" in order to give an indication of their open or closed positions. With protective goggles, it is difficult if not impossible to see indicia, so valve "feel" is very important.

Another problem encountered with these types of mono-propellant torch handles and valves is that the torch tip may be inadvertently removed while the valve is still in the open position. This can result in unwanted ignition of gas at the point of attachment of the tip to the handle. Still another problem encountered in soldering or brazing operations is that the valve is not always presented to the operator in the correct position for actuation due to twisting of the gas hose attached thereto.

Still further, dropping of some prior art valves can present a risk of inadvertent unwanted opening and discharge of combustible gas. Thus to a solution of these and other problems are the subject invention is directed.

SUMMARY AND OBJECTS OF THE INVENTION

The invention comprises a valve that is part of a torch handle assembly. The valve includes a generally cylindrical valve body having an axially disposed inlet opening and an inlet chamber. The generally cylindrical valve body has an axially disposed outlet chamber leading to a quick-disconnect coupling assembly for attachment of torch tips. A pair of spaced radially directed ports lead from the inlet and outlet chambers to the exterior of the valve body. The closely fitted actuator collar slidably mounted on the exterior of the valve body permits selective communication of the radially directed passages so as to open or close the valve.

A spring loaded coupling collar on the outlet end of the valve body is also adapted for axial sliding movement on the body. In its spring loaded forwardmost position, the torch tip is retained in place. The actuator and coupling collars are dimensioned and positioned on the valve body in such a way that retraction of the coupling collar will transmit motion to the contacting actuator collar and move it from the valve open to the valve closed position. Thus, the torch tip cannot be removed unless the actuator collar is moved to the closed position, thereby cutting off the flow of gas through the torch handle. If desired, the actuator collar can be further rotated so as to lock the valve in its closed and locked position.

It is therefore a primary object of this invention to provide improved torch handle with locking valve.

It is a further object to provide a torch handle wherein removal of the torch tip automatically shuts off the valve.

It is a further object of this invention to provide such a torch handle having a valve which may be positively locked in closed position.

It is a further object of this invention to provide a torch handle having a valve which is easily actuable with one hand and provides operator "feel" in both the closed and open positions.

It is a still further object to provide such a valve which is actuable in any rotational position of the torch handle containing the valve.

Further and other advantages and objects of the invention will become more apparent having reference to the accompanying drawings and the following detailed description and claims.

DETAILED DESCRIPTION OF THE INVENTION

Figure 1:
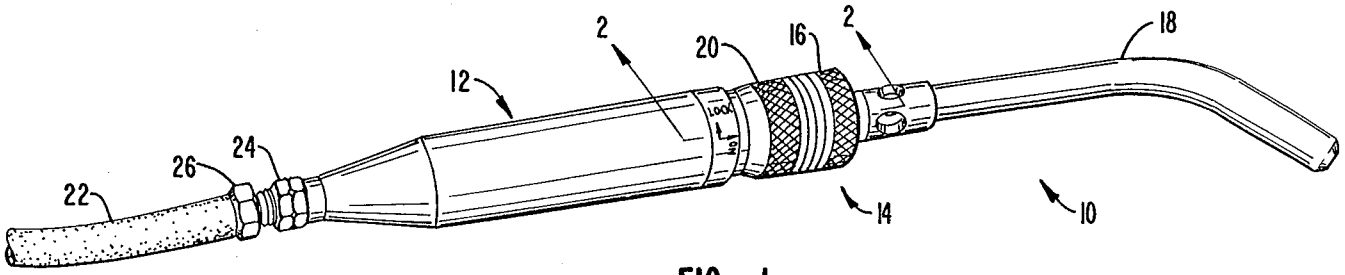
FIG. 1 is a an isometric view of a torch handle assembly including a locking valve of the instant invention.

Turning to FIG. 1, there is shown an overall isometric view of a mono-propellant soldering and brazing torch generally at 10. The torch includes a generally elongated handle 12 adapted for manual gripping. The handle may conveniently be of Bakelite or other plastic material which is resistant to thermal conduction. A valve assembly 14 at the front or outlet end of the handle will be more fully described hereinafter. A quickdisconnect coupling assembly 16 at the outlet end of the handle permits removable connection of a torch tip 18 thereto. An actuator collar 20 is slidable between closed and open positions.

The opposite or inlet end of the handle is connected to a mono-propellant gas supply such as propane (not shown). By means of a gas supply hose 22, hex nuts 24, 26 permit removable connection of the supply hose to the torch handle.

Figure 2:
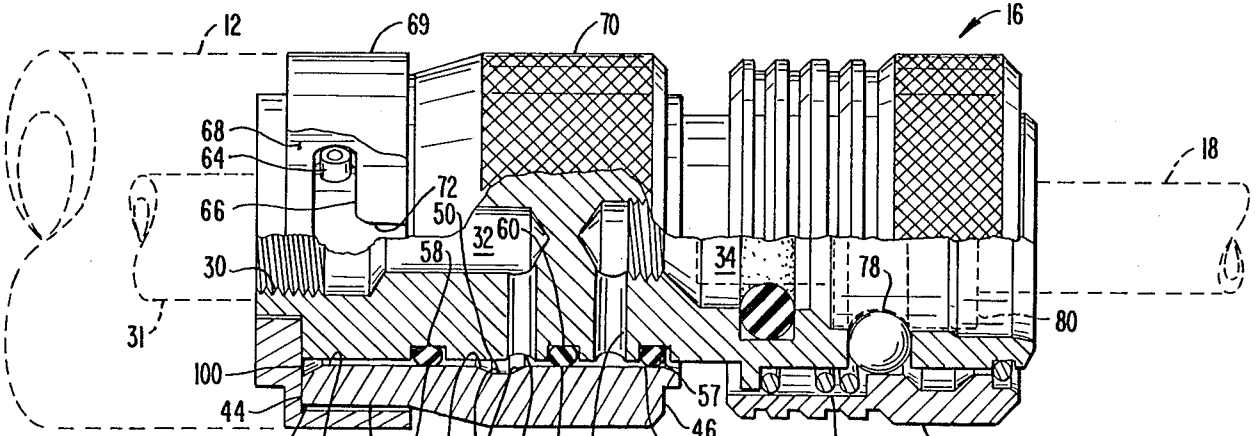
FIG. 2 is a partial cross-sectional view of the torch handle assembly taken along lines 2—2 in FIG. 1, illustrating details of the valve structure with the valve in a closed and locked position.

Turning now to FIG. 2, the valve assembly 14 comprises a generally cylindrical valve body 28 which may be made of brass material. The inlet end of valve body 28 is fitted within handle 12. A fluid inlet 30 leads to an inlet chamber 32 within valve body 28. Parenthetically, fluid such as combustible gas is conducted to inlet 30 by means of a hollow tube 31 contained within handle 12 and which leads from hex nut 24 previously shown in FIG. 1. An outlet chamber 34 is located within the valve body and leads to the quick-disconnect coupling assembly 16. A radially directed passage 36 communicates inlet chamber 32 with the exterior of the valve body. In like manner, a radially directed passage 38 communicates the exterior of the valve body with outlet chamber 34.

An annularly shaped actuator collar 20 has an interior cylindrical surface 42 of a diameter slightly larger than the external diameter of the valve body 28 so as to be in sliding engagement therewith. Midway between the ends of 44, 46 of actuator collar 20 is an internal annular groove 48 having a flat intermediate portion 50. The groove also has tapered inlet and outlet portions 52, 54, respectively. Positioned around valve body 28 are a plurality of annular O-ring grooves 55, 56, and 57. Each of these grooves contain a respective O-ring of rubber or other resilient material 58, 60, 62 for sealing against internal bore 42.

In the position shown, the valve is in its closed position with flow between inlet chamber 32 and outlet chamber 34. By means of ports 36 and 38 being interrupted by intermediate O-ring 60, the valve is shown in its locked position, which is achieved by manually rotating actuator collar 20 so that pin 64 slightly projecting from collar 20 is captured within a circumferentially directed notch 66 in a locking collar 68. A piece of metallic, adhesive-based tape 69 is bonded to locking collar 68 to prevent entry of debris into notch 66 which might otherwise foul the movement of pin 64 and other parts. Rotation of the locking collar is facilitated by means of scoring 70 on the external surface of locking collar 20. The valve may be unlocked by rotating the collar so that pin 64 is out of notch 66 and positioned to move axially through notch 72 in locking collar 68, as will be hereinafter described.

Figure 3:
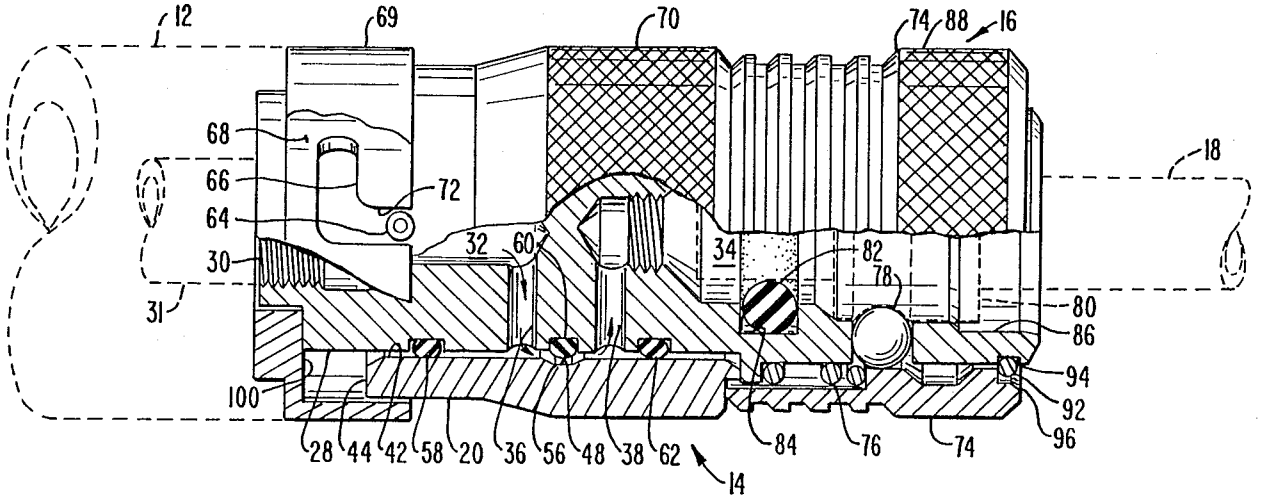
FIG. 3 is a partial cross-sectional view of the valve of FIG. 2 shown in the open position.

Turning now to FIG. 3, actuator collar 20 is shown advanced to the valve open position. In this position, intermediate O-ring 60 is positioned in line with internal annular groove 48. Inlet gas is thus able to pass from inlet chamber 32 through passage 36 and the space between the external surface of valve body 28 and annular groove 48. Gas then flows through passage 38 and into outlet chamber 34, where it communicates with quick-disconnect coupling assembly 16.

Quick-disconnect coupling assembly is positioned at the outlet end of valve body 28. The quick-disconnect coupling assembly 16 consists of a coupling collar 74 of generally annular shape which is spring-biased by means of a coil spring 76 into the forwardmost position shown in the drawing. In this position, three balls, one of which is shown at 78, are positioned in a radially innermost position so as to engage a corresponding annular groove (not shown) on the exterior surface of a mounting block 80 containing tip 18. An O-ring seal 82 of rubber or other resilient material contained within an internal annular groove 84 within the outlet 86 of the valve body ensures good sealing contact with tip mounting block 80. The tip 18 is press-fitted into mounting block 80.

In this manner, tip 18 is retained within coupling assembly 16. The material of seal 82 may be of a resilient material such as rubber. The external surface of coupling collar 74 includes suitable scoring 88 to facilitate manual gripping and actuation thereof. A plurality of exterior annular grooves 90 also facilitates such retraction. A spring ring 92 contained within an annular external groove 94 interacts with a similar internal annular groove 96 within collar 74 assembly when in the full forwardmost position to retain collar 74.

Figure 4:
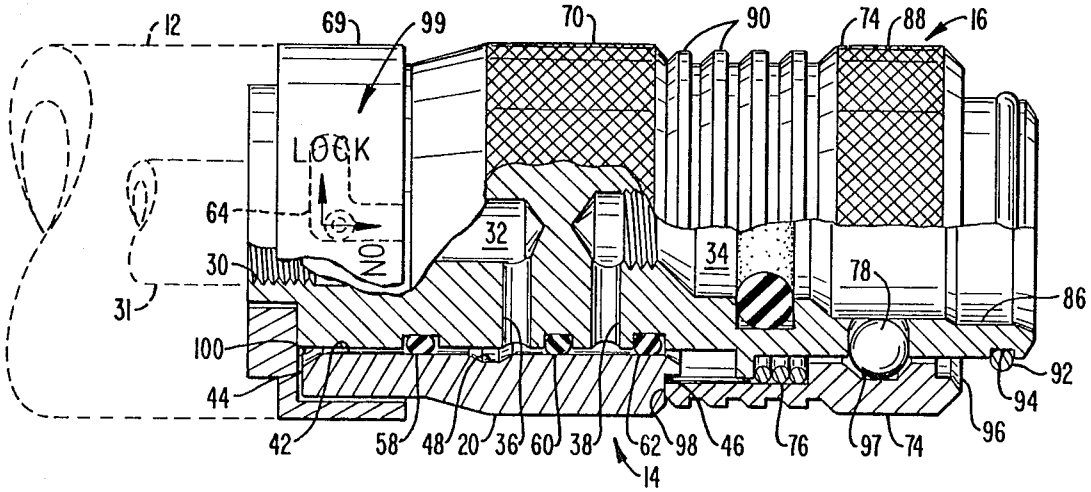
FIG. 4 is a partial cross-sectional view of the same with the valve in the closed position and showing the tip removed.

Turning to FIG. 4, the quick-disconnect coupling is shown in the position for removal of the tip. This position is achieved by manually retracting collar 74 against the biasing force of spring 76, thereby compressing the spring. At this point, ball 78 is forced into internal annular groove 97 within coupling collar 74. At the same time, the inner end 98 of coupling collar 74 contacts outer end 46 of actuator collar 20 and causes the motion of the former to be imparted to the latter. In this manner, actuator collar 20 is automatically retracted to the valve closed position incident to retraction of the coupling collar to remove the valve tip. The removal of the tip is thus prevented until the valve is closed. Friction existing between the O-rings 58, 60 and 62, and the internal bore 42 is sufficient to retain the valve in the closed position even though it has not rotated to the locked position wherein pin 64 is received within accommodating notch 66. Indicia 99 in the form of the words "LOCK" and "ON" are printed or stamped on the surface of tape 69 to indicate those positions of the valve.

In this position, end 44 of actuator collar 20 abuts against wall 100 of locking collar 68. This gives a "feel" to the operator of closure of the valve. A corollary "feel" is given to the operator when the valve is moved to the full open position with end wall 46 of actuator collar 20 abutting against coupling collar 74, as best seen in FIG. 3.

It is to be understood that while the invention has been described above in conjunction with a preferred specific embodiment thereof, the description is intended to illustrate and not limit the scope of the invention, which is defined by the scope of the appended claims.

What is claimed is:

1. A hand torch for use in soldering or brazing comprising:

a generally elongated handle adapted for gripping, a valve means mounted on said handle, said valve means including a body, an inlet and an outlet for passage of fluid therethrough, quick-disconnect means on said valve body communicating with said outlet actuable for selective retention of a torch tip, said valve means actuable to on or off positions to selectively communicate fluid from said inlet to said outlet, with said quick-disconnect means positioned adjacent said valve means when said valve means is in the on position, causing said valve means to move from the on to the off position incident to actuation of said quick-disconnect means to a position permitting removal of a torch, and further including, locking means on said valve body for selectively retaining said valve means in the off position, with said locking means configured to allow unhindered closure of the valve means by movement of either said valve means or said quick-disconnect means.

2. The invention of claim 1 wherein said valve body is a generally elongated member, said valve means comprising an annular actuator collar slidably movable on said valve body, said quick-disconnect means comprising an annular coupling collar on said valve body, so that retraction of said coupling collar to a position for disconnecting said tip moves said actuator collar and thereby said valve means from the on to the off position.

3. The invention of claim 2 wherein said valve means further comprises a pair of spaced apart radially directed passages in said valve body respectively communicating said inlet with the exterior of said valve body and said outlet with the exterior of said valve body.

4. The invention of claim 3 wherein said valve means further comprises three spaced annular O-ring grooves on said valve body, said radial passages being located intermediate said O-ring grooves, an O-ring seal within each O-ring groove, said O-ring seals serving to seal against the interior of said actuator collar.

5. The invention of claim 4 further including an annular groove within said actuator collar for communicating fluid between said ports when said actuator collar is moved to the valve open position wherein said annular groove is adjacent the centermost O-ring.

6. The invention of claim 5 wherein said valve means is dimensioned and positioned so that said actuator collar abuts against a wall of said locking collar when in the valve fully closed position.

7. The invention of claim 2 further including spring means of said valve body normally biasing said coupling collar to the torch tip retaining position.

8. The invention of claim 2 wherein said locking means comprises a pin on said actuator collar adapted for selective engagement with a notch on said locking collar.

* * * * *

UNITED STATES PATENT AND TRADEMARK OFFICE

CERTIFICATE OF CORRECTION

PATENT NO. : 4,756,686

DATED : July 12, 1988

INVENTOR(S) : Spolsino et al.

It is certified that error appears in the above-identified patent and that said Letters Patent is hereby corrected as shown below:

Col. 4, line 55: insert --tip-- between "torch" and ","; and

Col. 6, line 8: "means of" should be --means on--.

Signed and Sealed this

Eighth Day of November, 1988

*Attest:*

DONALD J. QUIGG

*Attesting Officer*

*Commissioner of Patents and Trademarks*